US006845849B2

(12) United States Patent
Bass

(10) Patent No.: US 6,845,849 B2
(45) Date of Patent: Jan. 25, 2005

(54) HEIGHT ADJUSTMENT CLIP FOR AN ELEVATOR DOOR

(75) Inventor: Patrick M. Bass, Lakeside, CA (US)

(73) Assignee: Thyssen Elevator Capital Corp, Whittier, CA (US)

( * ) Notice: Subject to any disclaimer, the term of this patent is extended or adjusted under 35 U.S.C. 154(b) by 205 days.

(21) Appl. No.: 10/348,440

(22) Filed: Jan. 21, 2003

(65) Prior Publication Data

US 2004/0149523 A1 Aug. 5, 2004

(51) Int. Cl.[7] ..... E05D 15/06; B66B 13/00
(52) U.S. Cl. ..... 187/334; 187/325; 16/105
(58) Field of Search ..... 187/313, 318, 187/324, 325, 333, 334; 403/83, 84, 85, 151; 16/105; 49/120, 370

(56) References Cited

U.S. PATENT DOCUMENTS

| | | | | | |
|---|---|---|---|---|---|
| 442,950 | A | * | 12/1890 | Bullard | 16/105 |
| 587,492 | A | * | 8/1897 | Prouty | 16/105 |
| 2,775,782 | A | * | 1/1957 | Boiu | 16/105 |
| 3,048,882 | A | * | 8/1962 | Tucker et al. | 16/105 |
| 3,555,612 | A | * | 1/1971 | Procton | 16/105 |
| 3,670,357 | A | * | 6/1972 | Steigerwald | 16/105 |
| 5,950,279 | A | * | 9/1999 | Chaput | 16/105 |
| 6,336,247 | B1 | * | 1/2002 | Schnoor | 16/105 |
| 6,609,849 | B2 | * | 8/2003 | Kalm et al. | 187/325 |

FOREIGN PATENT DOCUMENTS

| | | |
|---|---|---|
| AU | 499226 B | 4/1979 |
| AU | 531975 B | 9/1983 |
| JP | 09-240971 | 9/1997 |

* cited by examiner

*Primary Examiner*—Eileen D. Lillis
*Assistant Examiner*—Thuy v. Tran
(74) *Attorney, Agent, or Firm*—Frost Brown Todd LLC

(57) ABSTRACT

A height adjustment assembly connecting an elevator door to an elevator door hanger comprises a door bracket, a plurality of door clip receiving sections and corresponding number of door clips. Each door clip comprises upper and lower fins, side fins, and an oblique slot disposed centrally between the fins. Each oblique slot is aligned with an aperture in the receiving sections, and the upper and lower fins slidably engage corresponding slots in the receiving sections. A fastener inserted into the oblique slot in the door clip and the aperture in the door bracket holds the clip and the bracket onto the door hanger in a friction hold mode. The height of the door may be adjusted by moving the door clips laterally in the slots.

16 Claims, 5 Drawing Sheets

HEIGHT ADJUSTMENT CLIP FOR AN ELEVATOR DOOR

FIELD OF THE INVENTION

This invention relates to the field of elevator systems in general, and more particularly to a device for adjusting the height of elevator doors.

BACKGROUND OF THE INVENTION

Elevator doors in general require adjustment to fit properly into the opening of an elevator car. Conventionally, an elevator door is hung on a door hanger.

It is often necessary to make fine adjustments to the height of the elevator doors once the doors are hung on the hanger. For example, after a door is hung, it may be desirable to raise or lower it slightly to provide the proper clearance between the bottom of the door and the doorsill at the entry of the cab. Conventional doors allow for adjustment in height by providing bolt and slot configurations where the door is fastened to the hanger. The weight of the door makes adjustment cumbersome and usually requires more than one worker. One worker must raise or lower the door to the desired position while a second worker tightens the fastener. It would therefore be desirable to provide a height adjustment assembly for an elevator door that may be used easily and by only one worker hanging the door.

SUMMARY OF THE INVENTION

The present invention concerns a height adjustment assembly for fitting elevator doors into the door opening of an elevator car and a method of adjusting the height of elevator while the door is being fitted into the door opening.

In one embodiment of the present invention, the assembly comprises a bracket having a planar portion and an area for attachment to the top of the elevator door. The planar portion further comprises a plurality of door clip receiving sections, each door clip receiving section having an upper slot and a lower slot oriented parallel to one another and an aperture between the upper and lower slots. A plurality of door clips is provided, and each clip is disposed in a receiving section. Each door clip has a body having an upper fin slidably engaging the upper slot of the receiving section and a lower fin slidably engaging the lower slot of the receiving section. The door clip also has a slot between the fins and oriented obliquely with respect to the fins. A fastener passes through the slot and the aperture for frictionally holding the door clip and bracket to the door hanger. The height of the elevator door can then be adjusted relative to the door hanger device by moving the door clips laterally in the slots, which causes the oblique slot to move along the fastener and thereby vertically raise or lower the door.

The invention also concerns an elevator door and hanger having a height adjustment assembly comprising an elevator door; a hanger for supporting the elevator door and allowing horizontal sliding movement of the door; and the height adjustment assembly of the invention connecting the elevator door to the door hanger.

The invention also concerns a method of adjusting the height of an elevator door. The method includes providing a height adjustment assembly according to the invention. The door bracket of the assembly is atttached to the top of an elevator door. The door bracket is then held up against the door hanger until the aperture in each of the receiving sections of the door bracket is lined up with a corresponding hole in the door hanger ready to receive a fastener. A door clip is then placed within each of the receiving sections of the door bracket while aligning the oblique slot in the door clip with the fastener. Next, the upper and lower fins of the door clip are inserted into the corresponding upper and lower slots in the receiving sections of the door bracket. Gravity drops the door to a low position on the door hanger. While in the low position, the fastener is tightened to an adjustable state where the tightness provides sufficient friction to hold the door against the door hanger without slipping on the fastener. In the adjustable state, the fastener is not too tight to allow incremental movements of the oblique over the fastener when the clip is tapped. Then, small blows or taps on the side fins of the door clip move the door clip laterally within the upper and lower slots and the oblique slot relative to the fastener, thereby raising or lowering the door. When the desired door height is achieved, the fastener is tightened to a lock state to lock the door to the door hanger securely.

DETAILED DESCRIPTION

Figure 1:
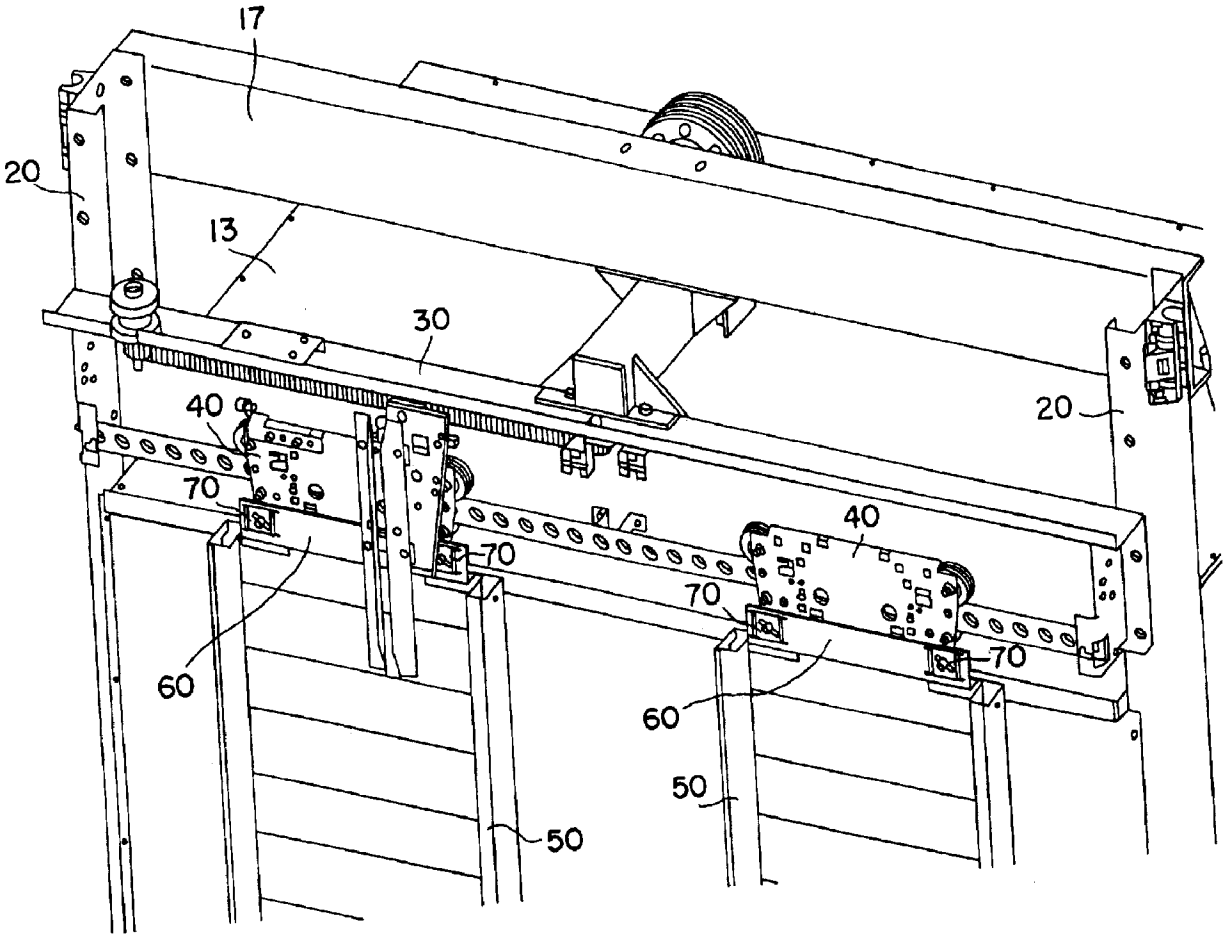
FIG. 1 is an embodiment of the present invention showing a height adjustment assembly for connecting an elevator door to an elevator door hanger.

FIG. 1 shows the basic structure of an elevator car 13 in a sling having stiles 20, bolster 17, and header 30. Stiles 20 and header 30 form a frame around the door opening. Door header 30 supports door hangers 40. Doors 50 hang from the door hangers 40.

Figure 2:
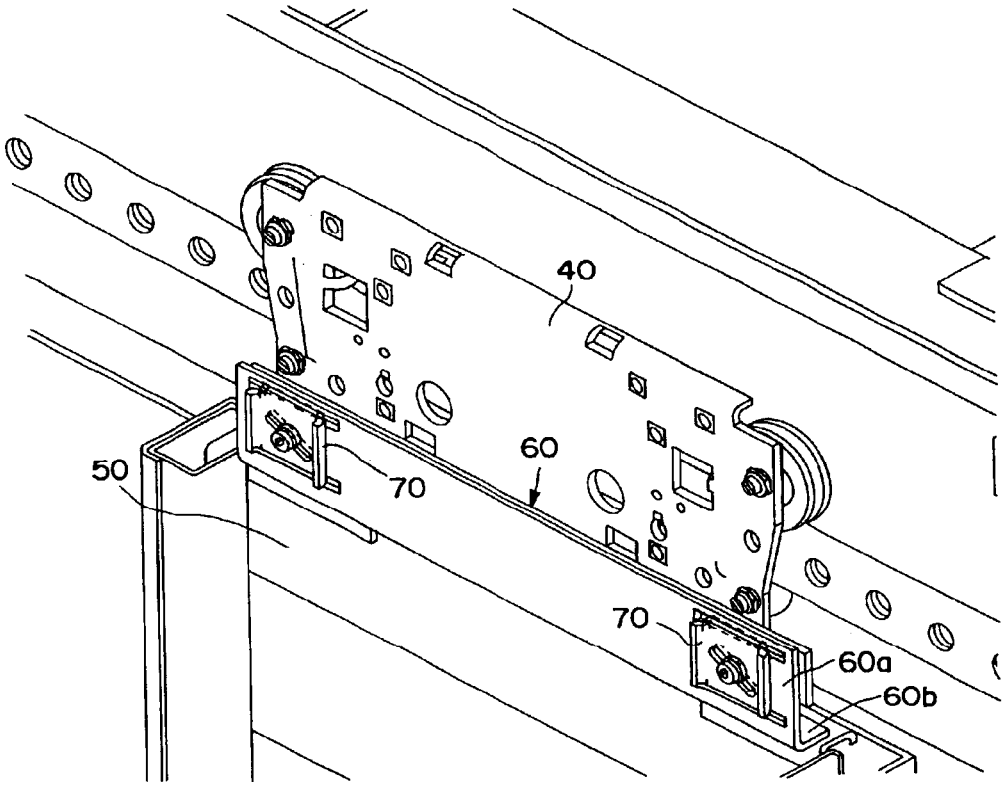
FIG. 2 shows a door hanger, set of door clips, and a door bracket adapted to receive the clips, according to the present invention.

As shown in FIG. 2, each door 50 is attached to its corresponding door hanger 40 by a height adjustment assembly of the invention. The height adjustment assembly includes a door bracket 60 having vertical planar portion 60*a* and preferably a right-angle area 60*b* for attachment to the top of elevator door 50. The planar portion 60*a* provides sections to receive a plurality of door clips 70 that are used for attaching the bracket 60 to the hanger 40 and for adjusting the height of the doors. It is preferred that the two proximate end sections of the bracket are used for this purpose.

Figure 3A:
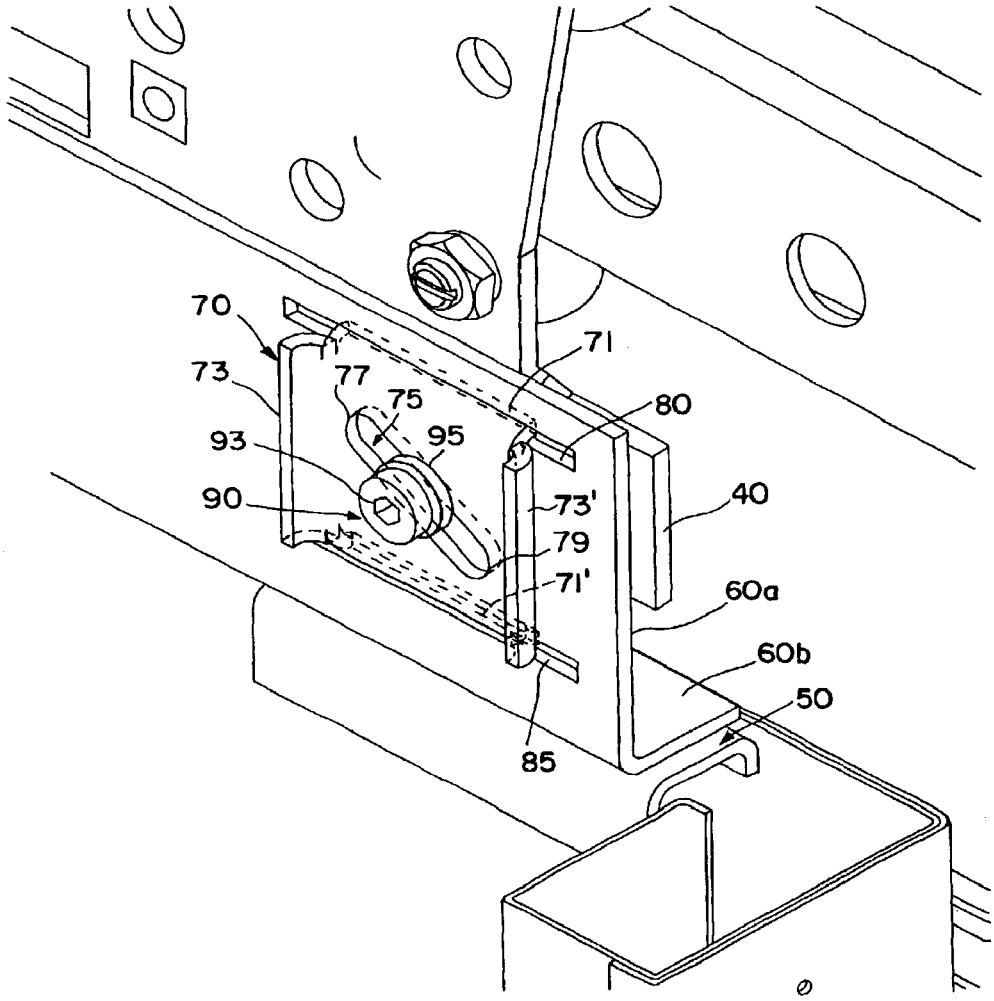
FIG. 3A shows a fastener holding a door clip and the door bracket onto the door hanger, according to the present invention.
Figure 3B:
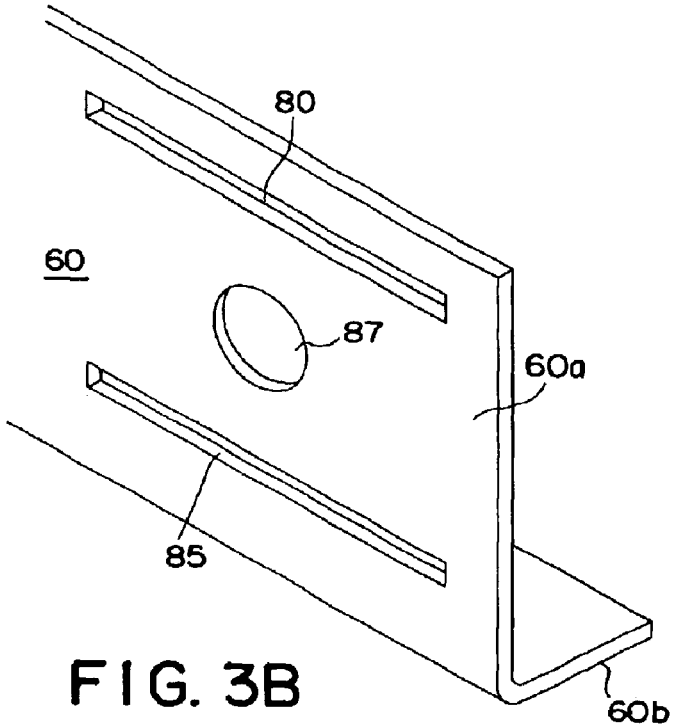
FIG. 3B shows a door bracket having upper and lower slots and an aperture disposed centrally between the slots, according to the present invention.
Figure 4:
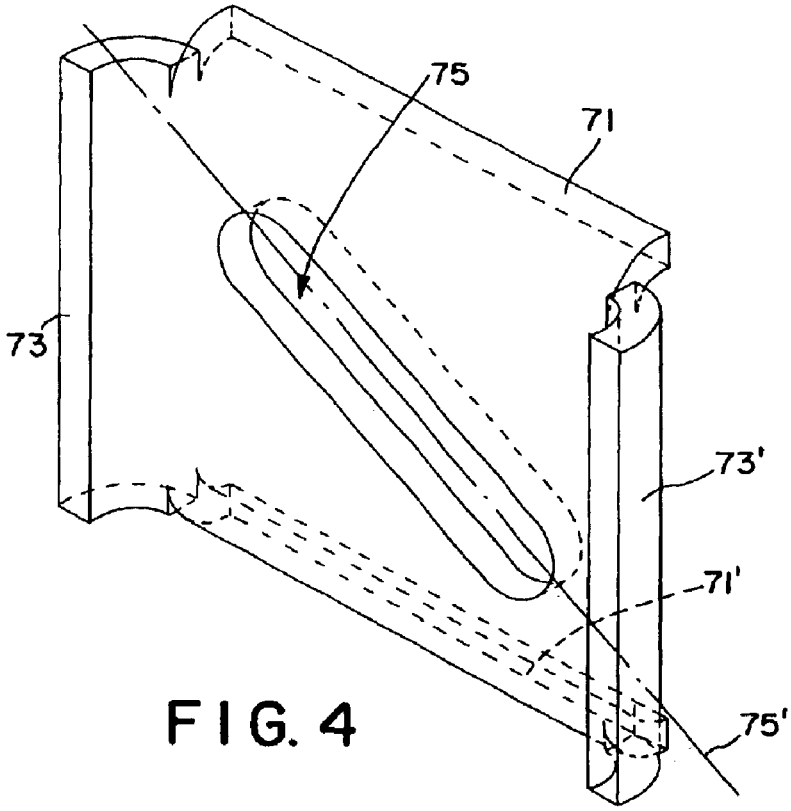
FIG. 4 shows a door clip, according to the present invention.

As shown in FIG. 3A, each door clip receiving section comprises upper slot 80 and lower slot 85, each slot adapted to receive a portion of door clip 70. An aperture 87 is also included between the slots 80 and 85 (See FIG. 3B). Door clip 70 comprises a body having upper fin portion 71 and lower fin portion 71' (Also see FIG. 4). Each fin 71 and 71' is formed outwardly from the planar body of the clip in order to slidably engage the corresponding upper and lower slots 80 and 85, respectively. The slots 80 and 85 are substantially wider than the width of fins 71 and 71' so that the fins can easily move laterally within their respective slots. Door clip 70 preferably includes additional side fins 73 and 73' that are formed in a direction opposite to that of the upper and lower fins. The side fins provide tapping surfaces that allow the worker to tap the clip and move it laterally within the slots 80 and 85. A slot 75 is disposed between fins 71 and 71', and oriented obliquely with respect to the fins. As shown in FIG. 4, oblique slot 75 is preferably formed centrally in clip 70 along axis 75' aligned diagonally with respect to the vertices of the clip.

Figure 5A:
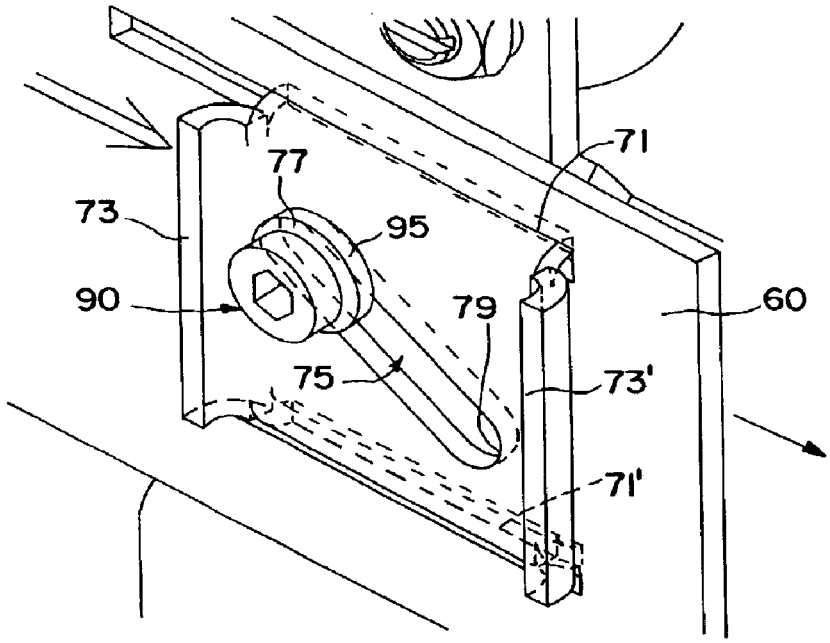
FIG. 5*a* shows the displacement of the door of FIG. 3 in an upward direction when one of the side fins of the door clip is tapped in the corresponding direction, according to the present invention.
Figure 5B:
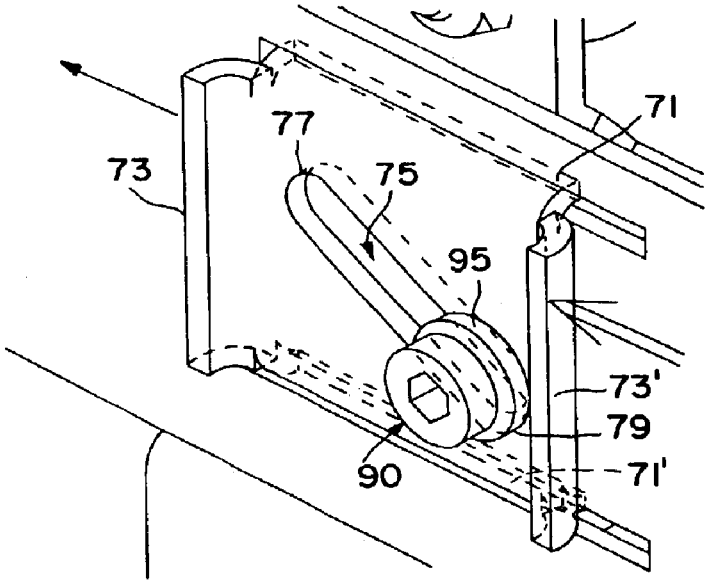
FIG. 5*b* shows the displacement of the door of FIG. 3 in a downward direction when one of the side fins of the door clip are tapped in the corresponding direction, according to the present invention.

Referring again to FIG. 3A, door 50 is attached to area 60*b* of bracket 60. Bracket 60 with door 50 attached thereto is then held up against door hanger 40 so that aperture 87 of bracket 60 is aligned with a hole in door hanger 40 ready to receive a fastener. Door clip 70 is then placed within the receiving section with door clip fins 71 and 71' aligned in upper and lower slots 80 and 85 and with oblique slot 75 aligned with aperture 87 in bracket 60 and with the hole in hanger 40. A fastener, such as bolt 90, passes through oblique slot 75 in each clip, and through aperture 87 of door bracket 60 and to the hole in door hanger 40, thereby fastening the clip and the door bracket to the door hanger. When the door is simply hung on to the door hanger without the tightening the bolt, that is, with the bolt in a "loose state," the door will, by gravity, drop to the "low position," with upper end 77 of oblique slot 75 shown in FIG. 3A resting on bolt 90 as shown in FIG. 5*a*. In other words, the weight of the door will make it slide, riding bolt 90 down the oblique slot. At the same time, upper and lower fins 71 and 71', respectively, will move laterally to the right in their corresponding slots 80 and 85. On the other hand, the door can be lifted upwards so that the clip now rides upwards until bolt stops at lower end 79 of the oblique slot while the upper and lower fins move laterally to the left as shown in FIG. 5*b*. In order to hold the door in the "up position," the bolt is tightened so that bearing surface 95 (such as a washer) of the bolt locks the door in the desired position.

The door height can be adjusted from the natural "low" position to any height within specifications through incremental steps. This is accomplished by tightening the bolt to provide sufficient friction hold on the door against the door hanger while the door is preferably in approximately the center position as shown in FIG. 3A. Then, small blows or taps on the side fins, namely, on fins 73 and 73' that provide tapping surfaces, advance the clips left or right, depending upon which fin is tapped. With each tap, therefore, the door moves vertically, that is, up or down. The tightness of the bolt is such that in its "adjustable state," the friction hold is sufficient to hold the weight of the door against the door hanger without slipping on the bolt, and yet not so tight as to prevent incremental movement along the oblique slot with each tap. After proper adjustment, the bolt is tightened to a "lock state" to hold the door securely in place.

While the invention has been particularly shown and described with reference to particular embodiments, those skilled in the art will understand that various changes in form and details may be made without departing form the spirit and scope of the invention.

What is claimed is:

1. A height adjustment assembly for connecting an elevator door to an elevator door hanger, the assembly comprising:

a bracket having a planar portion and an area for attachment to the top of the elevator door;

a plurality of door clip receiving sections in the planar portion, each door clip receiving section comprising an upper slot and a lower slot oriented parallel to one another and an aperture between the upper and lower slots;

a plurality of door clips individually disposed in each door clip receiving section, each door clip comprising a body having an upper fin slidably engaging the upper slot of the door clip receiving section and a lower fin slidably engaging the lower slot of the door clip receiving section, and a slot disposed between the fins and oriented obliquely with respect to the fins;

a fastener passing through the oblique slot and the aperture for frictionally fastening the door clip and bracket to the door hanger;

wherein the height of the elevator door may be adjusted relative to the door hanger by moving the door clips laterally in the slots, which causes the fastener to move along the oblique slots on the door clips.

2. The height adjustment assembly of claim 1, further comprising one or more lateral tapping areas on each door clip for providing a tapping surface;

wherein each door clip may be moved laterally within the upper and lower slots by tapping on the tapping surfaces to move the oblique slot relative to the fastener and thereby raise or lower the door.

3. The height adjustment assembly of claim 2, wherein the assembly comprises two door clip receiving sections and two door clips.

4. The height adjustment assembly of claim 2, wherein the fastener is a nut and a bolt.

5. The height adjustment assembly of claim 2, wherein the fastener is a bolt threaded into a threaded hole in the door hanger.

6. An elevator door and hanger having an height adjustment assembly comprising:

an elevator door;

a door hanger for supporting the elevator door and allowing horizontal sliding movement of the elevator door;

a height adjustment assembly connecting the elevator door to the door hanger, the height adjustment assembly comprising;

a. a bracket having a planar portion and an area attached to the top of the elevator door;

b. a plurality of door clip receiving sections in the planar portion, each door clip receiving section comprising an upper slot and a lower slot oriented parallel to one another and an aperture between the upper and lower slots;

c. a plurality of door clips individually disposed in each door clip receiving section, each door clip comprising a body having an upper fin slidably engaging the upper slot of the door clip receiving section and a lower fin slidably engaging the lower slot of the door clip receiving section, and a slot disposed between the fins and oriented obliquely with respect to the fins;

d. a fastener passing through the slot and the aperture and frictionally fastening the door clip and the bracket to the door hanger;

wherein the height of the door may be adjusted relative to the door hanger by moving the door clips laterally within the upper and lower slots of the door clip receiving section, which causes the oblique slots to move relative to the fastener.

7. The height adjustment assembly of claim 6, wherein the fastener is a nut and a bolt.

8. The height adjustment assembly of claim 6, wherein the fastener is a bolt threaded into a threaded hole in the door hanger.

9. The height adjustment assembly of claim 6, further comprising one or more lateral tapping areas on each door clip for providing a tapping surface;

wherein the door clip may be moved laterally within the upper and lower slots by tapping on the tapping surfaces to move the oblique slot relative to the fastener and thereby raise or lower the door.

10. The height adjustment assembly of claim 9, wherein the assembly comprises two door clip receiving sections and two door clips.

11. A method of adjusting the height of an elevator door, comprising the steps of:

providing a height adjustment assembly according to claim 1 for connecting an elevator door to an elevator door hanger;

attaching the bracket of the height adjustment assembly to the top of the elevator door;

holding the bracket up against the elevator door hanger until the aperture in each of the receiving sections of the door bracket is aligned with a corresponding hole in the door hanger ready to receive a fastener;

placing a door clip within each of the receiving sections of the door bracket;

inserting a fastener through the oblique slot in the door clip, the aperture in the receiving section and in to the hole on the door hanger;

tightening the fastener to an adjustable state;

tapping the door clip until the door height is adjusted; and tightening the fastener to a locked state.

12. The method according to claim 11, wherein the fastener is a nut and a bolt.

13. The method according to claim 11, wherein the fastener is a bolt threaded into a threaded hole in the door hanger.

14. The method according to claim 11, wherein the adjustable state is achieved by tightening the fastener until the friction hold is sufficient to hold the door against the door hanger without slipping.

15. The method according to claim 11, wherein the lock state is achieved by tightening the fastener until the door clip and the door are fastened securely to the door hanger.

16. The method according to claim 15, wherein the door clip may be moved laterally within the upper and lower slots by tapping on the tapping surfaces to move the oblique slot relative to the bolt and thereby raise or lower the door.

* * * * *